US010059124B2

(12) United States Patent
Ando

(10) Patent No.: US 10,059,124 B2
(45) Date of Patent: Aug. 28, 2018

(54) PRINTING APPARATUS

(71) Applicant: SEIKO EPSON CORPORATION, Tokyo (JP)

(72) Inventor: Masaaki Ando, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/048,294

(22) Filed: Feb. 19, 2016

(65) Prior Publication Data

US 2016/0271972 A1 Sep. 22, 2016

(30) Foreign Application Priority Data

Mar. 20, 2015 (JP) ..... 2015-057455

(51) Int. Cl.

| | |
|---|---|
| ***B41J 2/01*** | (2006.01) |
| ***B41J 11/00*** | (2006.01) |
| ***B41J 2/175*** | (2006.01) |
| ***B41J 2/18*** | (2006.01) |

(52) U.S. Cl.

CPC ..... *B41J 11/0015* (2013.01); *B41J 2/175* (2013.01); *B41J 2/18* (2013.01)

(58) Field of Classification Search

None

See application file for complete search history.

(56) References Cited

U.S. PATENT DOCUMENTS 6,174,055 B1 * 1/2001 Sugikubo ..... B41J 3/4078 347/18
2005/0219282 A1 10/2005 Kachi
2008/0273063 A1 * 11/2008 Wouters ..... B41J 2/1707 347/85
2008/0316244 A1 * 12/2008 Lugassi ..... C09D 11/101 347/16
2010/0259587 A1 10/2010 Uptergrove
2011/0050794 A1 * 3/2011 Koike ..... B41J 2/125 347/22
2012/0105533 A1 5/2012 Wozniak et al.

(Continued)

FOREIGN PATENT DOCUMENTS

EP 2082879 A2 7/2009
JP 2014-180857 A 9/2014

OTHER PUBLICATIONS

Tsukamoto, Ryuji, Ink Circulation Apparatus, Ink Circulation Method and Inkjet Recording Apparatus, Oct. 8, 2014, Europe, pp. 1-15.*

(Continued)

*Primary Examiner* — Matthew Luu
*Assistant Examiner* — Tracey McMillion

(57) ABSTRACT

A printing apparatus includes an ink ejecting head which ejects an ultraviolet curing ink, a supply flow path and a circulation outgoing path in which the ultraviolet curing ink which is supplied from an ink cartridge which stores the ultraviolet curing ink to the ink ejecting head flows, a circulation pump which is provided in the circulation outgoing path and emits heat, and a gas supplying module which is provided closer to an upstream side than the circulation pump in the supply flow path and the circulation outgoing path and supplies air to the ultraviolet curing ink which flows in the supply flow path.

5 Claims, 2 Drawing Sheets

(56) References Cited

U.S. PATENT DOCUMENTS

| | | | | |
|---|---|---|---|---|
| 2014/0240406 | A1* | 8/2014 | LaCaze | B41J 2/175 347/85 |
| 2014/0285596 | A1 | 9/2014 | Ando | |
| 2014/0300670 | A1* | 10/2014 | Tsukamoto | B41J 2/175 347/85 |

OTHER PUBLICATIONS

Tsukamoto, Ink Circulation Apparatus, Ink Circulation Mehtod and Inkjet Recording Apparatus, Oct. 8, 2014, Europe.*
The Extended European Search Report for the corresponding European Application No. 16159609.3 dated Aug. 18, 2016.

* cited by examiner

PRINTING APPARATUS

BACKGROUND

1. Technical Field

The present invention relates to a printing apparatus which ejects an ultraviolet curing ink.

2. Related Art

In the related art, there is known a printer which is provided with an ink cartridge, a head, a tube, a liquid pump, and a degassing module. The ink cartridge stores an ultraviolet curing ink, the head ejects the ultraviolet curing ink, the ultraviolet curing ink which is supplied from the ink cartridge to the head flows in the tube, the liquid pump is provided in the tube, and the degassing module is provided in the tube and removes bubbles from the ultraviolet curing ink. In the printer, the generation of polymerized foreign matter in the ultraviolet curing ink is suppressed by controlling a vacuum degree of the degassing module such that the dissolved oxygen content in the ultraviolet curing ink does not become less than 6 ppm (refer to JP-A-2014-180857).

The present inventor discovered the following problems.

In a printing apparatus such as the printer of the related art, when the dissolved oxygen content of the ultraviolet curing ink which is stored in an ink storage section is low, even if the vacuum degree of the degassing module is controlled, the dissolved oxygen content of the ultraviolet curing ink remains low. In this case, there is a concern that the ultraviolet curing ink will undergo a polymerization reaction and that polymerized foreign matter will be generated in the ultraviolet curing ink due to the heat which is emitted from a heating section which is provided in an ink flow path.

SUMMARY

An advantage of some aspects of the invention is to provide a printing apparatus capable of suppressing the generation of polymerized foreign matter in an ultraviolet curing ink.

According to an aspect of the invention, there is provided a printing apparatus which includes an ink ejecting head which ejects an ultraviolet curing ink, an ink flow path in which the ultraviolet curing ink which is supplied from an ink storage section which stores the ultraviolet curing ink to the ink ejecting head flows, a heat emitting section which is provided in the ink flow path and emits heat, and a gas supplying section which is provided closer to an upstream side than the heat emitting section in the ink flow path and supplies a gas containing oxygen to the ultraviolet curing ink which flows in the ink flow path.

In this case, even when the dissolved oxygen content of the ultraviolet curing ink which is stored in the ink storage section is low, the ultraviolet curing ink with a high dissolved oxygen content reaches the heat emitting section due to the ultraviolet curing ink passing through the gas supplying section. Therefore, the polymerization reaction of the ultraviolet curing ink caused by the heat emission of the heat emitting section is suppressed. Therefore, the printing apparatus is capable of suppressing the generation of polymerized foreign matter in the ultraviolet curing ink.

In the printing apparatus, the gas supplying section preferably supplies the gas to the ultraviolet curing ink such that a polymerizable temperature of the ultraviolet curing ink which passes through the gas supplying section and reaches the heat emitting section exceeds a heat emission temperature of the heat emitting section.

In this case, the polymerization reaction of the ultraviolet curing ink caused by the heat emission of the heat emitting section is more effectively suppressed.

In the printing apparatus, a dissolved oxygen content of the ultraviolet curing ink which passes through the gas supplying section and reaches the heat emitting section is preferably 5 ppm or more.

In the printing apparatus, the heat emission temperature of the heat emitting section is preferably 50° C. to 100° C.

In the printing apparatus, the heat emitting section preferably includes a gear pump.

In this case, while the gear pump emits heat due to the friction between gears, the polymerization reaction of the ultraviolet curing ink caused by the heat emission is suppressed.

The printing apparatus preferably further includes an ink reservoir section which is provided between the ink storage section and the ink ejecting head and reserves the ultraviolet curing ink in the ink flow path, and a supply pump which is provided closer to the upstream side than the ink reservoir section and pumps the ultraviolet curing ink which is stored in the ink storage section to the ink reservoir section in the ink flow path, in which the gear pump is preferably provided closer to a downstream side than the ink reservoir section, and the gas supplying section is preferably provided between the supply pump and the ink reservoir section.

When the gas supplying section is provided between the ink storage section and the supply pump, or, between the ink reservoir section and the gear pump, since the ultraviolet curing ink is pulled from the gas supplying section to the supply pump or the gear pump by negative pressure, there is a concern that too much gas will be supplied to the ultraviolet curing ink in the gas supplying section and that bubbles will form in the ultraviolet curing ink.

In response to this concern, in this case, since the ultraviolet curing ink is pumped from the supply pump to the gas supplying section under pressure due to the gas supplying section being provided between the supply pump and the ink reservoir section, too much gas being supplied to the ultraviolet curing ink in the gas supplying section is suppressed. Therefore, in this case, the formation of bubbles in the ultraviolet curing ink in the gas supplying section is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of a printing apparatus 1 according to the embodiment of the invention with reference to the accompanying drawings.

Figure 1:
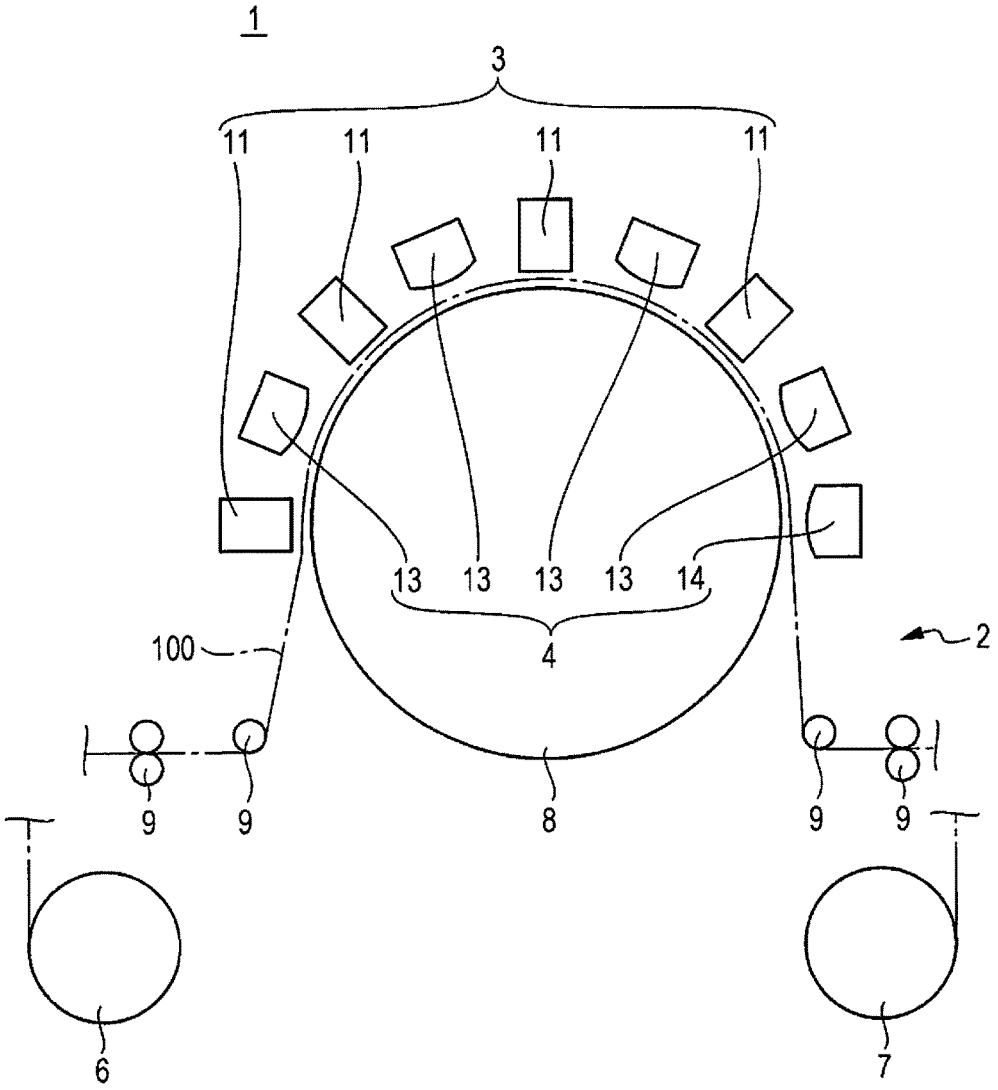
FIG. 1 is a schematic configuration diagram of a printing apparatus according to an embodiment of the invention.

Description will be given of the overall configuration of the printing apparatus 1 with reference to FIG. 1. The printing apparatus 1 performs printing on a printing medium 100 which is set therein by ejecting an ultraviolet curing ink (hereinafter referred to as a "UV ink"). The printing medium 100 is a belt-shaped continuous paper sheet. Note that, the material of the printing medium 100 is not particularly limited, and various materials such as paper-based materials and film-based materials may be used.

The printing apparatus 1 is provided with a feed section 2, an ink ejecting section 3, and an irradiating section 4. Although omitted from the drawing in FIG. 1, the printing apparatus 1 is provided with an ink supply section 5 (refer to FIG. 2) which supplies a UV ink to the ink ejecting section 3.

The feed section 2 is a roll-to-roll system and feeds the printing medium 100. The feed section 2 is provided with a feed-out reel 6, a winding reel 7, a rotating drum 8, and a plurality of rollers 9. The printing medium 100 which is fed out from the feed-out reel 6 passes the rotating drum 8 and the plurality of rollers 9 and is wound onto the winding reel 7. The rotating drum 8 is a cylindrical drum which is supported by a supporting mechanism (not shown) to be capable of rotating. When the printing medium 100 is fed along the circumferential surface of the rotating drum 8, the rotating drum 8 is passively rotated due to the friction force between the circumferential surface and the printing medium 100. The rotating drum 8 functions as a platen in relation to the ink ejecting section 3.

The ink ejecting section 3 is provided with a plurality of head units 11. The plurality of head units 11 is provided to line up along the circumferential surface of the rotating drum 8. The plurality of head units 11 correspond, one-for-one, with a plurality of types of UV ink (for example, the four colors CYMK). Each of the head units 11 is provided with a plurality of ink ejecting heads 12 (refer to FIG. 2) which eject UV ink using an ink jet system. The head units 11 eject the UV inks onto the printing medium 100 which is supported on the circumferential surface of the rotating drum 8. Accordingly, a color image is formed on the printing medium 100.

The UV ink contains various additives such as a polymerizable monomer, a polymerization initiator, a colorant, and a polymerization inhibitor. As the UV ink, it is preferable to use a radical polymer-based ink which contains a polymerization initiator which breaks down under ultraviolet rays to generate radicals.

The irradiating section 4 is provided with a plurality of temporary curing irradiators 13 and a real curing irradiator 14. The plurality of temporary curing irradiators 13 is provided to line up along the circumferential surface of the rotating drum 8 alternately, one for each of the plurality of head units 11. The temporary curing irradiators 13 are provided on the downstream side of the feed path of the printing medium 100 in relation to the corresponding head units 11. The temporary curing irradiators 13 irradiate the printing medium 100 onto which the UV ink is ejected with ultraviolet rays. Accordingly, the UV ink is temporarily cured straight after landing on the printing medium 100, and spreading of the dots and mixing of the colors are suppressed. The real curing irradiator 14 is provided closer to the downstream side than the temporary curing irradiator 13 which is provided closest to the downstream side in the feed path. The real curing irradiator 14 irradiates the printing medium 100 which is subjected to the ejection of the UV inks and the temporary curing with ultraviolet rays of a greater integral light quantity than the temporary curing irradiators 13. Accordingly, the UV ink which lands on the printing medium 100 is completely cured and is fixed to the printing medium 100.

Note that, it is possible to use, for example, a light emitting diode (LED) lamp, a high pressure mercury lamp, or the like which radiates ultraviolet rays in the temporary curing irradiators 13 and the real curing irradiator 14.

Figure 2:
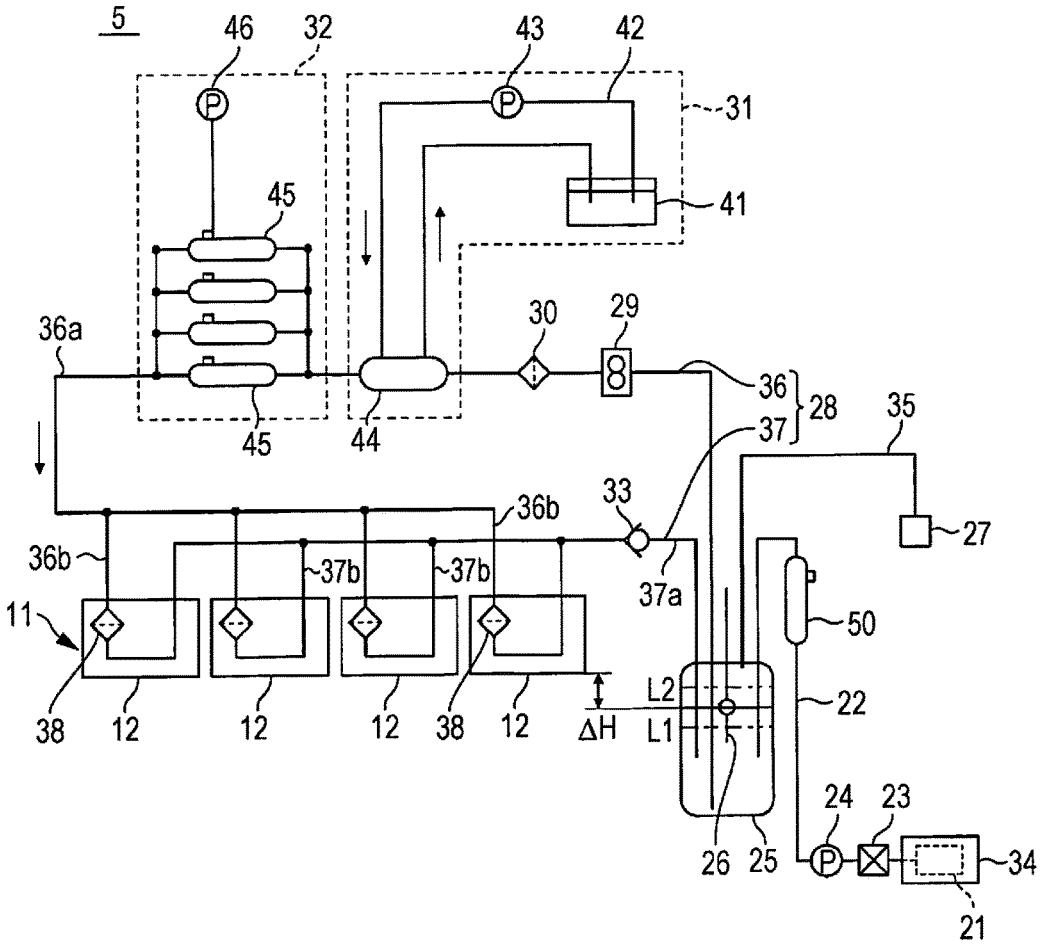
FIG. 2 is a piping flow diagram illustrating an ink supply section which is provided in the printing apparatus illustrated in FIG. 1.

Description will be given of the ink supply section 5 with reference to FIG. 2. The ink supply section 5 is provided with an ink cartridge 21, a supply flow path 22, a supply open-close valve 23, a supply pump 24, a sub-tank 25, a liquid level sensor 26, a compressing-decompressing section 27, an ink circulation flow path 28, a heating section 31, a degassing section 32, an outgoing path filter 30, a check valve 33, and a gas supplying module 50.

The UV ink is stored in the ink cartridge 21. The ink cartridge 21 is mounted in a holder 34. The upstream end of the supply flow path 22 is inserted into the ink cartridge 21 which is mounted in the holder 34, and the downstream end of the supply flow path 22 is inserted into the sub-tank 25. In order from the upstream side, the supply open-close valve 23, the supply pump 24, and the gas supplying module 50 are provided in the supply flow path 22. The supply open-close valve 23 opens and closes the supply flow path 22. It is possible to use a magnetic operation valve, for example, as the supply open-close valve 23. The supply pump 24 supplies the UV ink which is stored in the ink cartridge 21 to the sub-tank 25 via the supply flow path 22. Description will be given of the gas supplying module 50 later.

The sub-tank 25 temporarily reserves the UV ink which is pumped from the ink cartridge 21. The sub-tank 25 is an open system tank. The liquid level sensor 26 detects whether or not the liquid level of the UV ink in the sub-tank 25 is greater than or equal to a first liquid level L1, and detects whether or not greater than or equal to a second liquid level L2 which is greater than the first liquid level L1. When the liquid level sensor 26 detects that the liquid level of the UV ink in the sub-tank 25 is less than the first liquid level L1, the UV ink is supplied from the ink cartridge 21 to the sub-tank 25. When the liquid level sensor 26 detects that the liquid level of the UV ink in the sub-tank 25 is greater than or equal to the second liquid level L2, the supply of the UV ink from the ink cartridge 21 to the sub-tank 25 is stopped. Accordingly, the liquid level of the sub-tank 25 is maintained between the first liquid level L1 and the second liquid level L2. Therefore, a differential head Δ between the nozzle surface of the ink ejecting head 12 and the liquid surface of the sub-tank 25 is maintained within a predetermined range. Accordingly, the back pressure of the UV ink inside the ink ejecting head 12 is maintained within a predetermined range (for example, −400 Pa to 3000 Pa), and a good meniscus is formed in the nozzles of the ink ejecting head 12.

The compressing-decompressing section 27 compresses or decompresses the inside of the sub-tank 25 by supplying air into the sub-tank 25 or discharging the air in the sub-tank 25 via an air flow path 35. For example, the compressing-decompressing section 27 compresses the sub-tank 25 during the initial filling of the ink circulation flow path 28 with the UV ink, during the cleaning of the ink ejecting heads 12, or the like.

The ink circulation flow path 28 is the flow path of the UV ink which passes from the sub-tank 25, through the ink ejecting heads 12, and returns to the sub-tank 25. The ink circulation flow path 28 is provided with a circulation outgoing path 36 and a circulation return path 37.

The UV ink which is supplied to the ink ejecting heads 12 from the sub-tank 25 flows in the circulation outgoing path 36. The circulation outgoing path 36 is provided with an outgoing path side root path 36*a* and a plurality of outgoing path side branch paths 36*b* which branch from the outgoing path side root path 36*a*. The upstream end of the outgoing path side root path 36*a* is inserted into the sub-tank 25. In order from the upstream side, the outgoing path side root path 36*a* is provided with a circulation pump 29, the outgoing path filter 30, the heating section 31, and the degassing section 32. One of the outgoing path side branch paths 36*b* is provided for one of the ink ejecting heads 12. The downstream end of the outgoing path side branch path 36*b* is connected to the ink ejecting head 12.

The UV ink which returns to the sub-tank 25 from the ink ejecting head 12 flows in the circulation return path 37. In other words, of the UV ink which is supplied from the sub-tank 25 to the ink ejecting head 12 via the circulation outgoing path 36, the UV ink which is not ejected from the ink ejecting heads 12 returns to the sub-tank 25 via the circulation return path 37. The circulation return path 37 is provided with a plurality of return path side branch paths 37*b*, and a return path side root path 37*a* at which the plurality of return path side branch paths 37*b* meet n the downstream side thereof. One of the return path side branch paths 37*b* is provided for one of the ink ejecting heads 12. The upstream end of the return path side branch path 37*b* is connected to the ink ejecting head 12. The downstream end of the return path side root path 37*a* is inserted into the sub-tank 25. The check valve 33 is provided in the return path side root path 37*a*.

The circulation pump 29 pumps the UV ink which is reserved in the sub-tank 25 toward the ink ejecting head 12 side. Note that, it is possible to favorably use a gear pump as the circulation pump 29 because it is possible to suppress pulsation and there is little fluctuation in the flow rate with the passage of time. The circulation pump 29 emits heat locally due to the friction between gears. The heat emission temperature of the circulation pump 29 is 50° C. to 100° C., for example. The circulation pump 29 is provided with a DC motor as a drive source.

The outgoing path filter 30 removes foreign matter in the UV ink by filtering the UV ink which flows in the circulation outgoing path 36. Examples of the foreign matter include dust which is mixed in when the upstream end of the supply flow path 22 is inserted into the ink cartridge 21, and the like. Note that, although head filters 38 which filter the UV ink are also provided on the inlet side of the ink ejecting heads 12, it is possible to cause the head filters 38 which are difficult to exchange to last a long time by providing the outgoing path filter 30 in the circulation outgoing path 36.

The heating section 31 heats the UV ink which flows in the ink circulation flow path 28 to a predetermined temperature (for example 35° C. to 40° C.). The predetermined temperature is a temperature at which the UV ink which is supplied to the ink ejecting heads 12 reaches a viscosity which is appropriate for ejection from the ink ejecting heads 12. During the start-up of the printing apparatus 1, the printing apparatus 1 starts the printing operation after heating the UV ink which has a lower temperature than the predetermined temperature to the predetermined temperature using the heating section 31.

The heating section 31 is provided with a hot water tank 41 including a heater and a thermometer, a hot water circulation flow path 42, a hot water pump 43, and a heat exchanger 44. The hot water tank 41 reserves hot water which is adjusted to fall within a predetermined temperature range. The hot water circulation flow path 42 is a flow path running from the hot water tank 41, through the heat exchanger 44, and returns to the hot water tank 41. The hot water pump 43 causes the hot water to circulate within the hot water circulation flow path 42. The heat exchanger 44 performs heat exchanging between the hot water which flows in the hot water circulation flow path 42 and the UV ink which flows in the circulation flow path 28.

The degassing section 32 degasses the UV ink which flows in the ink circulation flow path 28. Accordingly, the supplying of the UV ink containing bubbles to the ink ejecting heads 12 is prevented. The degassing section 32 is provided with a degassing module 45 and a negative pressure pump 46. The degassing module 45 is provided with a plurality of hollow fiber membranes, for example. The negative pressure pump 46 reduces the pressure outside of the hollow fiber membranes. Accordingly, the UV ink which flows in the hollow fiber membranes is degassed.

The check valve 33 allows the flowing of the UV ink to the sub-tank 25 side in the circulation return path 37 and prevents the backward flowing of the UV ink to the ink ejecting head 12 side. The flowing of foreign matter contained in the UV ink which flows backward in the circulation return path 37 into the ink ejecting heads 12 is suppressed by the check valve 33. Note that, in a case in which the circulation return path 37 is removed from the sub-tank 25 in order to exchange a portion of the ink ejecting heads 12 or the like, the UV ink flows backward to the ink ejecting head 12 side in the circulation return path 37.

Incidentally, there is a case in which a radical polymerization reaction takes place in the UV ink due to the friction heat which is generated by the circulation pump 29 which is a gear pump. Foreign matter (hereinafter referred to as "polymerized foreign matter") which is generated by a polymerization reaction of the UV ink caused by the heat emission of the circulation pump 29 becomes the cause of clogging or wearing in the circulation pump 29 and shortens the lifespan of the circulation pump 29. When the polymerized foreign matter which is generated by the circulation pump 29 reaches the ink ejecting heads 12, the polymerized foreign matter becomes the cause of ejection faults.

In a UV ink with a high dissolved oxygen content, the radical polymerization reaction is suppressed using oxygen which has a high reactivity with the radicals. Therefore, it is thought that the polymerization reaction of the UV ink caused by the heat emission of the circulation pump 29 may be suppressed by storing the UV ink with a high dissolved oxygen content in the ink cartridge 21. However, since the oxygen is consumed by reacting with the radicals even during the storage of the ink cartridge 21, the dissolved oxygen content drops. Therefore, when the ink cartridge 21 which is subjected to long-term storage is mounted in the printing apparatus 1, it may not be possible to suppress the polymerization reaction of the UV ink caused by the heat emission of the circulation pump 29. Before reaching the circulation pump 29, the UV ink is reserved in the sub-tank 25 and comes into contact with the air in the sub-tank 25; however, when the amount of the UV ink ejected from the ink ejecting heads 12 is great, since the time for which the UV ink is retained in the sub-tank 25 is short, a substantial increase in the dissolved oxygen content of the UV ink in the sub-tank 25 may not be anticipated. In the printing apparatus 1 of the present embodiment, the gas supplying module 50 is provided between the supply pump 24 and the sub-tank 25.

The gas supplying module 50 supplies the air to the UV ink which is pumped under pressure from the supply pump 24. Accordingly, even when the dissolved oxygen content of the UV ink which is stored in the ink cartridge 21 is low, the UV ink with a high dissolved oxygen content reaches the circulation pump 29. The gas supplying module 50 is provided with a plurality of hollow fiber membranes, for example, in the same manner as the degassing module 45. The air is supplied to the UV ink by the UV ink passing the outside of the hollow fiber membranes in a state in which air of an atmospheric pressure is supplied to the inside of the hollow fiber membranes. Therefore, conversely, in comparison to a case in which the UV ink passes through the inside of the hollow fiber membranes in a state in which air of an atmospheric pressure is supplied to the outside of the hollow fiber membranes, the pressure loss of the UV ink in the gas supplying module 50 is reduced.

Hereinafter, more specific description will be given of the invention in an example and a comparative example.

EXAMPLE

In the printing apparatus 1 of the present embodiment, the UV ink which is heated to 35° C. is caused to circulate within the ink circulation flow path 28. At this time, the heat emission temperature of the circulation pump 29 is 75° C. The dissolved oxygen content of the UV ink within the ink cartridge 21 is 2 ppm, and the dissolved oxygen content of the UV ink which passes through the gas supplying module 50 and reaches the circulation pump 29 is 10 ppm. As a result, the generation of polymerized foreign matter in the UV ink is not observed.

Note that, whether or not the polymerized foreign matter is generated in the UV ink is determined according to whether or not captured polymerized foreign matter is present in the outgoing path filter 30. In other words, the outgoing path filter 30 is observed and when captured polymerized foreign matter is present in the outgoing path filter 30, it is determined that the polymerized foreign matter is generated in the UV ink.

Comparative Example

The comparative example is carried out in the same manner as the example except for in that air is not supplied into the hollow fiber membranes in the gas supplying module 50. In this case, the dissolved oxygen content of the UV ink which passes through the gas supplying module 50 and reaches the circulation pump 29 remains at 2 ppm. As a result, the generation of polymerized foreign matter in the UV ink is observed.

Polymerizable Temperature

The polymerizable temperature of the UV ink is 55° C. when the dissolved oxygen content is 2 ppm, 90° C. when the dissolved oxygen content is 5 ppm, 110° C. when the dissolved oxygen content is 10 ppm, and 120° C. when the dissolved oxygen content is 15 ppm. Note that, 15 ppm is the saturation dissolved oxygen content of the UV ink at atmospheric pressure, 25° C. The polymerizable temperature of the UV ink means the lowest heat emission temperature of the circulation pump 29 at which the UV ink undergoes the polymerization reaction when the circulation pump 29 is operated while changing the heat emission temperature of the circulation pump 29. For example, when the dissolved oxygen content is 2 ppm, the UV ink does not undergo the polymerization reaction when the heat emission temperature of the circulation pump 29 is lower than 55° C.; however, the UV ink undergoes the polymerization reaction when the heat emission temperature of the circulation pump 29 is 55° C. or higher. Whether or not the UV ink undergoes the polymerization reaction is determined by whether or not the fluctuation range of the load torque of the DC motor of the circulation pump 29 increases due to an increase in the viscosity of the polymerized UV ink. In other words, in comparison to when the applied current value of the DC motor is the current value (for example, 10 mA) during stable operation, when the current value (for example 50 mA or higher) is multiplied by five or more, it is determined that the UV ink is subjected to the polymerization reaction.

It is preferable that the gas supplying module 50 supplies the air to the UV ink such that the polymerizable temperature of the UV ink which passes through the gas supplying module 50 and reaches the circulation pump 29 exceeds the heat emission temperature of the circulation pump 29. In the example described above, since the heat emission temperature of the circulation pump 29 is 75° C., it is preferable that the air is supplied to the UV ink such that the polymerizable temperature of the UV ink exceeds 75° C., that is, such that the dissolved oxygen content of the UV ink is 5 ppm or more.

As described above, according to the printing apparatus 1 of the present embodiment, even when the dissolved oxygen content of the UV ink which is stored in the ink cartridge 21 is low, the UV ink with a high dissolved oxygen content reaches the circulation pump 29 due to the UV ink passing through the gas supplying module 50. Therefore, the polymerization reaction of the UV ink caused by the heat emission of the circulation pump 29 is suppressed. Therefore, the printing apparatus 1 is capable of suppressing the generation of polymerized foreign matter in the UV ink.

According to the printing apparatus 1 of the present embodiment, since the UV ink is pumped under pressure from the supply pump 24 to the gas supplying module 50, too much air being supplied to the UV ink in the gas supplying module 50 is suppressed. Therefore, according to the printing apparatus 1 of the present embodiment, the formation of bubbles in the UV ink in the gas supplying module 50 is suppressed.

Note that, the ink cartridge 21 is an example of "an ink storage section". The supply flow path 22 and the circulation outgoing path 36 are examples of "an ink flow path". The circulation pump 29 is an example of "a heat emitting section". The gas supplying module 50 is an example of "a gas supplying section". The sub-tank 25 is an example of "an ink reservoir section".

The invention is not limited to the embodiment described above, and it goes without saying that various configurations may be adopted within a scope that does not depart from the gist of the invention. For example, the present embodiment may be modified to the forms described below.

The installation position of the gas supplying module 50 is not particularly limited as long as the installation position is closer to the upstream side than the circulation pump 29, and, for example, may be between the ink cartridge 21 and the supply pump 24, or may be between the sub-tank 25 and the circulation pump 29.

In contrast with the embodiment described above, in the gas supplying module 50, the UV ink may pass through the inside of the hollow fiber membranes in a state in which the air of an atmospheric pressure is supplied to the outside of the hollow fiber membranes.

Air may be supplied to the gas supplying module 50 at a higher pressure than atmospheric pressure. Accordingly, in the gas supplying module 50, more air is supplied to the UV ink and it is possible to increase the dissolved oxygen content of the UV ink. However, in this case, there is a concern that bubbles will be formed in the UV ink in the gas supplying module 50.

The gas which is supplied to the gas supplying module 50 is not particularly limited to a gas containing oxygen, and may be oxygen itself, for example.

The entire disclosure of Japanese Patent Application No. 2015-057455, filed Mar. 20, 2015 is expressly incorporated by reference herein.

What is claimed is:

1. A printing apparatus comprising:

an ink ejecting head which ejects an ultraviolet curing ink;

an ink flow path in which the ultraviolet curing ink which is supplied from an ink storage section which stores the ultraviolet curing ink to the ink ejecting head flows;

a heat emitting section which is provided in the ink flow path and emits heat; and a gas supplying section which is provided closer to an upstream side than the heat emitting section in the ink flow path and supplies a gas containing oxygen to the ultraviolet curing ink which flows in the ink flow path, the gas supplying section supplying the gas to the ultraviolet curing ink such that a polymerizable temperature of the ultraviolet curing ink which passes through the gas supplying section and reaches the heat emitting section exceeds a heat emission temperature of the heat emitting section.

2. The printing apparatus according to claim 1, wherein a dissolved oxygen content of the ultraviolet curing ink which passes through the gas supplying section and reaches the heat emitting section is 5 ppm or more.

3. The printing apparatus according to claim 1, wherein a heat emission temperature of the heat emitting section is 50° C. to 100° C.

4. The printing apparatus according to claim 1, wherein the heat emitting section includes a gear pump.

5. The printing apparatus according to claim 4, further comprising:

an ink reservoir section which is provided between the ink storage section and the ink ejecting head and reserves the ultraviolet curing ink in the ink flow path; and a supply pump which is provided closer to the upstream side than the ink reservoir section and pumps the ultraviolet curing ink which is stored in the ink storage section to the ink reservoir section in the ink flow path, wherein the gear pump is provided closer to a downstream side than the ink reservoir section, and the gas supplying section is provided between the supply pump and the ink reservoir section.

* * * * *